US006457420B2

(12) United States Patent
Laporte et al.

(10) Patent No.: US 6,457,420 B2
(45) Date of Patent: Oct. 1, 2002

(54) RAIL VEHICLE INCLUDING AN END CAR EXTENDED BY A CAB

(75) Inventors: Jean-Jacques Laporte, La Rochelle; Frédéric Papin, Verines, both of (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 09/861,644

(22) Filed: May 22, 2001

(30) Foreign Application Priority Data

May 22, 2000 (FR) ..... 00 06517

(51) Int. Cl.[7] ..... B61F 5/00

(52) U.S. Cl. ..... 105/456; 105/199.2; 105/453

(58) Field of Search ..... 105/456, 199.1, 105/199.2, 199.3, 199.5, 194, 241.2, 453, 454

(56) References Cited

U.S. PATENT DOCUMENTS

| | | | | |
|---|---|---|---|---|
| 2,012,260 A | | 8/1935 | De Saint-Martin | |
| 3,030,897 A | | 4/1962 | Barry | |
| 4,069,767 A | * | 1/1978 | Glaze | 105/164 |

FOREIGN PATENT DOCUMENTS

| | | | | |
|---|---|---|---|---|
| CH | 141733 | | 5/1930 | |
| DE | 2711646 A1 | * | 9/1977 | |
| DE | 27 11 646 | | 9/1977 | B61D/1/00 |
| DE | 196 52 700 | | 6/1997 | B61C/17/04 |
| EP | 0 630 789 | | 12/1994 | B61C/17/04 |
| EP | 0630789 A1 | * | 12/1994 | |
| FR | 2689476 A1 | * | 10/1993 | |

* cited by examiner

*Primary Examiner*—S. Joseph Morano
*Assistant Examiner*—Frantz F. Jules
(74) *Attorney, Agent, or Firm*—Sughrue Mion, PLLC

(57) ABSTRACT

A rail vehicle including an end car extended by a cab, wherein the car and the cab have separate structures with adjacent ends that are pivotally mounted on the same bogie, the structure of the cab being supported solely by the bogie while cantilevered therefrom, the cab being connected to a control device for controlling the angular positioning of the cab relative to the bogie.

6 Claims, 2 Drawing Sheets

RAIL VEHICLE INCLUDING AN END CAR EXTENDED BY A CAB

The invention relates to rail vehicles and, more particularly, to-rail vehicles including an end car extended by a cab.

BACKGROUND OF THE INVENTION

In the rail industry, and in particular for trams, it is known to have driving cabs which are welded or bolted to the end of the end car. Such cabs are generally cantilevered out from the pivot axis of the bogie and have the drawback, when the car is engaged in a bend, of being off-centered towards the outside of the bend. Unfortunately, a general problem which exists for all rail vehicles is that of complying with the established railway loading gauge.

A known solution for limiting off-centering of the cab in bends consists in positioning the bogies as close as possible to the ends of the car. However, such a solution has the drawback of increasing off-centering of the middle of the car towards the inside of the bend, and thus of increasing the ground area occupied by the vehicle in bends.

Another known solution for limiting off-centering of the cab in bends consists in designing cabs of converging shape, having sides that taper so as to remain within the limits of the loading gauge when the car takes a bend. However, such a solution has the drawback of reducing the volume of the cab and of complicating its manufacture.

OBJECT AND SUMMARY OF THE INVENTION

An object of the present invention is thus to remedy those drawbacks by proposing a rail vehicle including an end car which is extended by a cab whose ground occupancy is optimized in bends so as to remain within the loading gauge of the track, and thus make it possible to use an extended cab or a cab of width that is identical to the vehicle loading gauge over substantially the entire length of the cab.

The invention preferably applies to trams for which the problem of cab size in bends is increased because of the need to take tight bends.

The invention provides a rail vehicle including an end car extended by a cab, wherein the car and the cab have separate structures with adjacent ends that are pivotally mounted on the same bogie., the structure of the cab being supported solely by the bogie while cantilevered therefrom, the cab being connected to control means for controlling the angular positioning of the cab relative to the bogie.

According to another characteristic of the invention, the control means ensure that the cab turns towards the inside of the bend, relative to the bogie, while being servocontrolled by the turning movement of the adjacent car relative to the bogie.

According to yet another characteristic of the invention, the car and the cab are mounted to pivot relative to the same axis carried by the bogie.

According to another characteristic of the invention, the control means are constituted by mechanical elements connecting the cab to the adjacent car.

BRIEF DESCRIPTION OF THE DRAWINGS

The objects, characteristics, and advantages of the present invention will be better understood on reading the following description of two embodiments of the invention, given as non-limiting examples, and with reference to the accompanying drawings, in which.

MORE DETAILED DESCRIPTION

To make the drawings easier to understand, only the elements necessary for understanding the invention are shown. The same elements have the same references in all of the figures.

Figure 1:
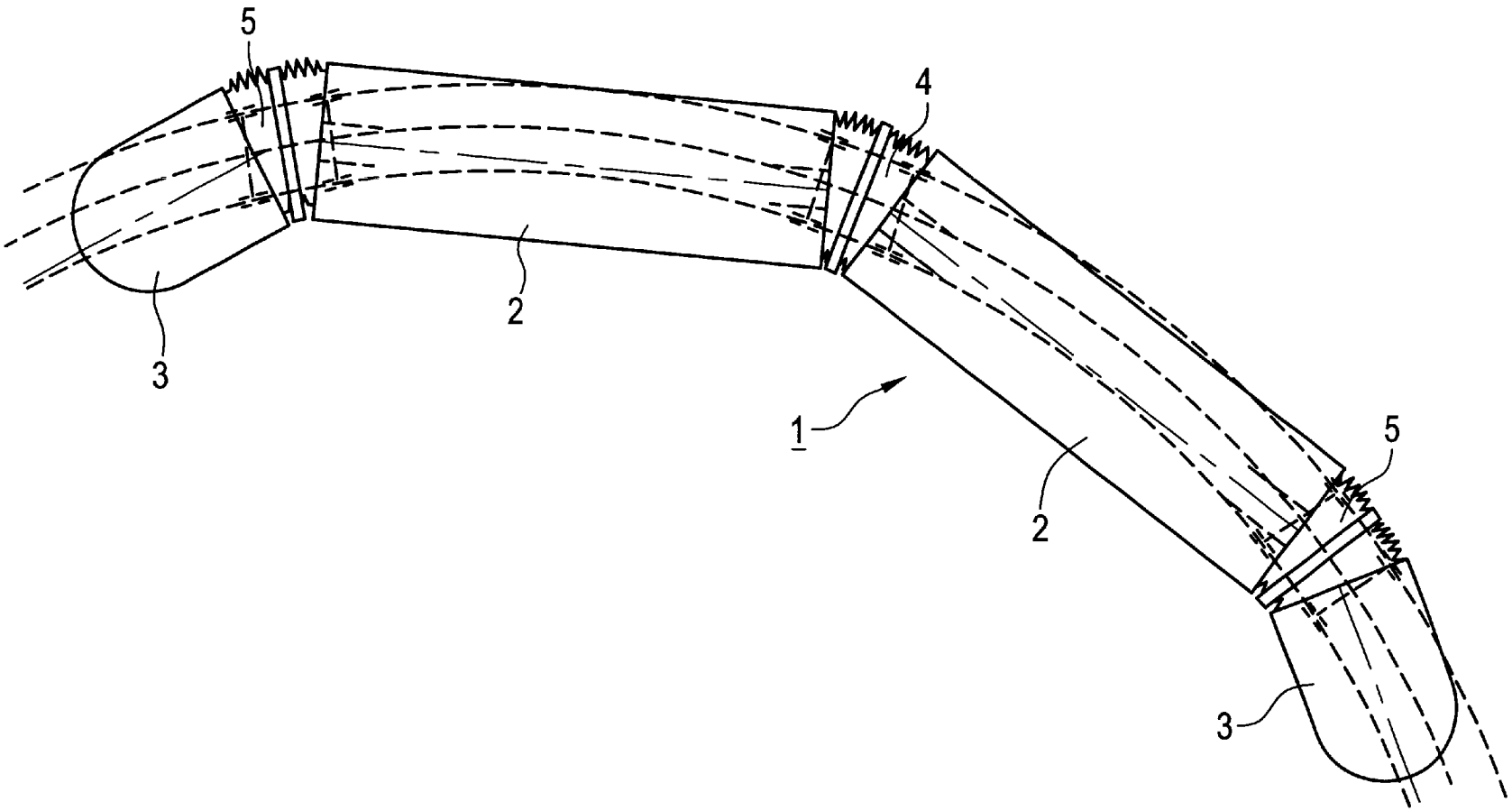
FIG. 1 is a diagrammatic view from above or a rail vehicle of the invention on a bend.

FIG. 1 shows a rail vehicle 1 of the tram type, including two passenger cars 2 connected together by a bogie 4 that is capable of pivoting relative to the structure of the cars 2. The cars 2 are extended at the head and the tail of the tram 1 by respective cabs 3 each having a structure that is independent from the structure of the cars 2. The structure of the cab 3 is supported by a single bogie 5 provided with two axles, said bogie also supporting the end of the adjacent car 2. The cab is cantilevered out from the bogie 5 so as to project forwards from the bogie 5.

The structures of the cab 3 and of the adjacent car 2 are articulated about the same axis 8 disposed at the center of the bogie 5, enabling the car 2 and the cab 3 to pivot to either side of the longitudinal axis of the bogie 5. Concertina-like bellows, shown diagrammatically in FIG. 1, are disposed at the sides of the bogies 4 and 5 so as to cover the intercommunication zone, and shock absorbers (not shown) can optionally be added to damp the motion of the cars 2 and the cabs 3.

Figure 2:
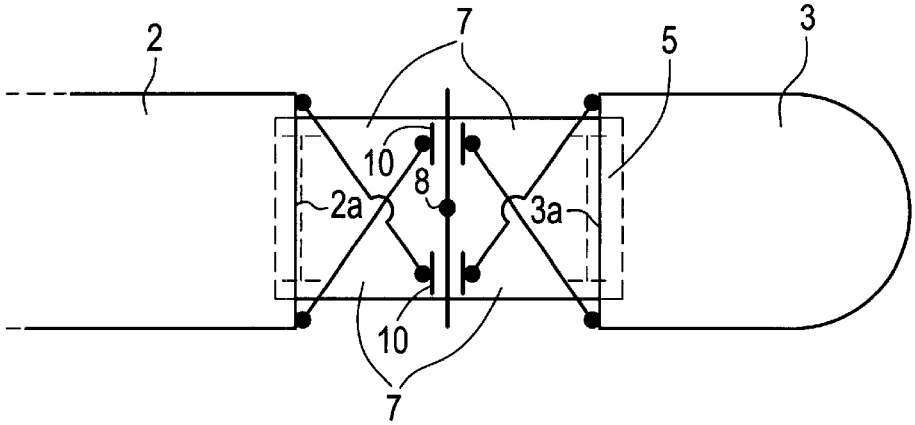
FIG. 2 is a view from above of a first embodiment of the control means for controlling the angular positioning of the cab of the vehicle of the invention when the vehicle is on a straight.
Figure 3:
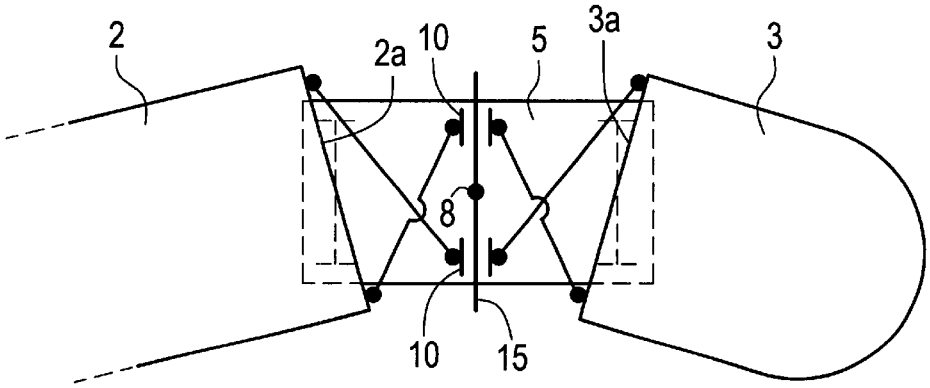
FIG. 3 is a view similar to FIG. 2 when the end car and the cab are on a bend.
Figure 4:
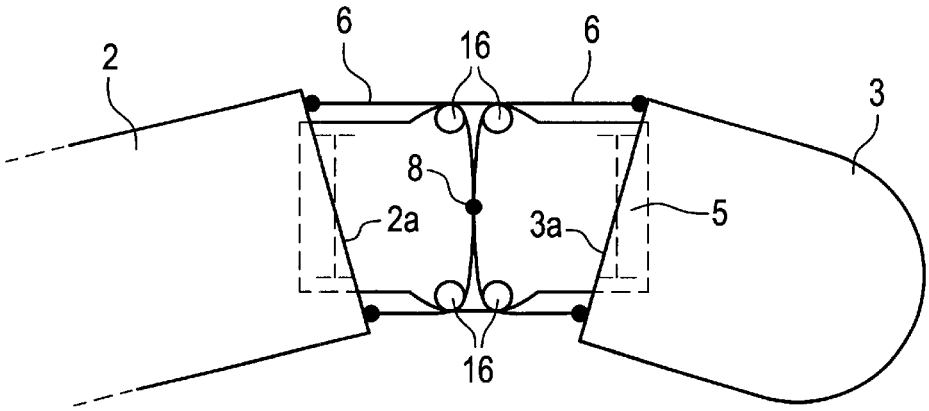
FIG. 4 is a view from above of a second embodiment of the control means for controlling the angular positioning of the cab of the vehicle of the invention, on a bend.

In FIGS. 2 to 4, each cab 3 is connected to the adjacent car 2 by control means for angularly positioning the cab 3 relative to the bogie 5 in proportion to the angular position of the adjacent car 2 relative to the same bogie 5.

In a first embodiment shown in FIGS. 2 and 3, the control means for controlling the angular positioning of the cab 3 are constituted by two pairs of connecting rods 7 that are disposed symmetrically about the longitudinal axis of the vehicle. Each pair of connecting rods is disposed in a V-shape so as to connect the cab 3 and the adjacent car 2 to a slide 10 that moves along a guide rail 15, the guide rail 15 being carried by the bogie 5 and extending transversely to the bogie 5 and being centered on the pivot axis 8 about which the cab 3 and the car 2 are articulated.

In FIG. 2, a first slide 10, that moves over the longitudinal lefthand side of the bogie 5, is connected by a pair of connecting rods 7 to the righthand side edge of the rear face 3*a* of the cab 3 and to the righthand side edge of the front face 2*a* of the adjacent car 2. A second slide 10, that moves over the longitudinal righthand side of the bogie 5, is connected by a pair of connecting rods 7 to the lefthand side edge of the rear face 3*a* of the cab 3 and to the lefthand side edge of the front face 2*a* of the adjacent car 2. Both ends of each connecting rod 7 are provided with ball joints enabling the connecting rod 7 to pivot relative to its fixing points.

In the example shown, the connecting rods 7 are all of the same length.

Operation of the control means for controlling the cab 3 using connecting rods 7 is described below:

In FIG. 3, when the tram 1 arrives at a bend, the bogie 5 takes up a position that is tangential to the bend, thereby turning relative to the front face 2*a* of the adjacent car 2. The turning of the bogie 5 relative to the car 2 causes the slides 10 to move along the guide rail 15 because of the connecting rods 7 connecting the car 2 to the slides 10. Since the slides 10 are also connected to the cab 3 by the connecting rods 7, displacement of the slides 10 causes the cab 3 to turn about the axis 8,towards the inside of the of the bend. In the example shown, since the lengths of the connecting rods 7 are the same, the angle of the cab 3 relative to the bogie 5 is identical to the angle of the bogie 5 relative to the adjacent car 2.

However, in variant embodiments not shown in the figures, the cab 3 could be made to turn towards the inside of the bend to a greater or lesser extent by modifying the length of the controlling connecting-rods 7 and by modifying the positions of the fixing points of the connecting rods 7 on the cab 3 and on the car 2.

In a second embodiment shown in FIG. 4, the control means for controlling the angular positioning of the cab 3 .relative to the bogie 5 are constituted by a pair of cables 6 that are symmetrically disposed about the longitudinal axis of the bogie 5, coming from each side edge of the structure of the cab in order to connect to the other side edge of the structure of the adjacent car 2.

Each cable 6 is guided along its path by two guide rollers 16 that are vertically fixed on the bogie 5. The guide rollers 16 are disposed on the bogie 5, symmetrically about the axis 8 and in the proximity of the side edge of the bogie 5, so that each cable 6 passes over two rollers 16, following an S-shaped path. The length of the cables 6 is adapted so that the cables 6 are taut between the edge of the cab 3 and the edge of the adjacent car 2.

Such control means using cables 6 enables the cab 3 to be turned relative to the bogie 5 when, on a bend, the bogie 5 is turned relative to the adjacent vehicle 2. Turning the bogie 5 causes the cables 6 to slide over the rollers 16, thereby causing the cab 3 to turn symmetrically towards the inside of the bend.

In variant embodiments not shown, the guide rollers 16 and the fixing points for the cables 6 can be positioned differently in order to increase or decrease the amount the cab 3 turns relative to the amount the adjacent car 2 turns.

The rail vehicle of the invention thus has the advantage of reducing the off-centering of the cab in bends by the way the cab is articulated on the bogie and by the cab turning in bends in proportion to the amount the bogie turns relative to the adjacent car. Such a rail vehicle thus enables cabs to be used that are more spacious, both in length and in width, for the same track loading gauge.

Naturally, the invention is not limited to the embodiments described and shown, which have been given only as examples.

Thus, in another embodiment not shown, the control means can be constituted by jacks connecting the cab to the bogie, the jacks being controlled either manually, or automatically as a function of the angular position of the bogie relative to the adjacent car detected by means of sensors.

What is claimed is:

1. A rail vehicle including an end car extended by a cab, wherein said car and said cab have separate structures with adjacent ends that are pivotally mounted on a common bogie, the structure of said cab being supported solely by the bogie while cantilevered therefrom, said cab being connected to control means for controlling an angular positioning of said cab relative to said bogie.

2. The rail vehicle according to claim 1, wherein said control means ensures that said cab turns towards an inside of a bend, relative to said bogie, while being servocontrolled by a turning movement of an adjacent car relative to said bogie.

3. The rail vehicle according to claim 1, wherein said car and said cab are mounted to pivot relative to a common pivot axis carried by said bogie.

4. The rail vehicle according to claim 3, wherein said control means comprises mechanical elements connecting said cab to an adjacent car.

5. The rail vehicle according to claim 4, wherein said control means comprises cables coming from each side edge of said cab in order to connect to the other side edge of the adjacent car, each of said cables presenting an S-shaped path, by passing over guide rollers that are vertically fixed on said bogie so that a turning movement of said bogie relative to said car causes the cables to slide along the guide rollers, and said cab to turn towards an inside of a bend.

6. A rail vehicle including an end car extended by a cab, wherein said car and said cab have separate structures with adjacent ends that are pivotally mounted on a common bogie, the structure of said cab being supported solely by the bogie while cantilevered therefrom, said cab being connected to a control mechanism which controls an angular positioning of said cab relative to said bogie, wherein said car and said cab are mounted to pivot relative to a common pivot axis carried by said bogie; and wherein said control mechanism comprises mechanical elements connecting said cab to an adjacent car, said mechanical elements comprising two pairs of connecting rods that are disposed symmetrically about a longitudinal axis of said bogie, each pair of connecting rods being disposed in a V-shape so as to connect said car and said cab to a slide that moves along a guide rail carried by said bogie, said guide rail extending transversely to said bogie and being centered on the common pivot axis.

* * * * *